United States Patent [19]

Jönsson

[11] Patent Number: 5,067,614

[45] Date of Patent: Nov. 26, 1991

[54] PACKING CONTAINER PROVIDED WITH OPENING ARRANGEMENT

[75] Inventor: Tommy Jönsson, Malmö, Sweden

[73] Assignee: Tetra Pak Holdings S.A., Pully, Switzerland

[21] Appl. No.: 483,115

[22] Filed: Feb. 22, 1990

[30] Foreign Application Priority Data

Mar. 7, 1989 [SE] Sweden ..... 8900792

[51] Int. Cl.[5] ..... B65D 77/30

[52] U.S. Cl. ..... 229/123.1; 229/123.3; 229/125.08; 229/125.09

[58] Field of Search ..... 206/601, 631, 631.1-631.3, 206/633; 220/269, 315; 229/123.1-123.3

[56] References Cited

U.S. PATENT DOCUMENTS

| | | | |
|---|---|---|---|
| 1,451,612 | 4/1923 | Haussner . | |
| 2,105,455 | 1/1938 | Sebell . | |
| 2,738,916 | 3/1956 | Peters | 229/123.3 |
| 3,302,818 | 2/1967 | Balocca et al. | 229/123.2 |
| 3,889,844 | 6/1975 | Viker et al. | 229/123.1 |
| 3,900,155 | 8/1975 | Rausing et al. | 229/123.1 |
| 3,977,591 | 8/1976 | Martensson et al. | 229/123.1 |
| 3,999,678 | 12/1976 | Ignell et al. | 220/269 |
| 4,231,487 | 11/1980 | Hasegawa | 220/269 |
| 4,630,312 | 12/1986 | Milstein | 383/86 |
| 4,703,518 | 10/1987 | Ausnit | 383/63 |
| 4,706,297 | 11/1987 | Ausnit | 383/63 |
| 4,715,528 | 12/1987 | Kjelgaard et al. | 229/123.1 |
| 4,790,436 | 12/1988 | Nakamura | 229/123.1 |

FOREIGN PATENT DOCUMENTS

| | | |
|---|---|---|
| 1489296 | 6/1967 | France . |
| 8701097 | 2/1987 | PCT Int'l Appl. . |
| 451012 | 3/1987 | Sweden . |
| 423606 | 10/1966 | Switzerland . |

*Primary Examiner*—Jimmy G. Foster

*Attorney, Agent, or Firm*—Burns, Doane, Swecker & Mathis

[57] ABSTRACT

An opening arrangement of the reclosable type on a packing container (2) includes a double strip or a doubled strip (5,5',5'') applied to the outside of the container. The double strip (5) includes two overlapping strip portions (5*a* and 5*b*) covering in an openable manner an emptying opening (4) incorporated beforehand in the container. A reclosing of the container after opening is made possible in that the bottom strip portion (5*b*) comprises one or more protruding parts (14) which to this end can engage detachably in one or more corresponding seats (15) formed in the upper strip portion (5*a*).

10 Claims, 2 Drawing Sheets

PACKING CONTAINER PROVIDED WITH OPENING ARRANGEMENT

BACKGROUND OF THE INVENTION

1. Field of the Invention

The present invention relates to packing containers and more particularly to packing containers provided with opening arrangements.

2. Description of the Prior Art

Conventional, so-called non-returnable, packages for liquid foodstuffs are manufactured at present in most cases with the help of modern packing machines of the type which both form, fill and close finished packages from either a web or from prefabricated blanks of a laminated packing material, generally plastic-coated paper. Packages are manufactured, for example, from a web wherein two longitudinal edges of the web are combined with one another in an overlap joint so as to form a tube which thereafter is filled with the intended contents and is divided into filled, cushionlike packing units by repeated transverse sealing of the advancing tube below the contents level of the tube. The sealed packing units are separated from one another by cuts in the transverse seals and are given the desired final geometric shape, usually parallelepipedic, by means of a subsequent shaping and sealing operation during which the triangular, double-walled corner lugs of the separated packing units are folded in against, and sealed to, the outside of the packages.

For the convenience of the user the packages are provided in most cases with some type of opening arrangement with the help of which the packages easily can be broken into without the use of scissors or similar tools. A further demand made on an opening arrangement functioning well is that it should provide the package with good pouring properties which means, among other things, that it should be possible to pour out the contents of the package conveniently in a coherent and well-directed jet.

Conventional packages provided with an opening arrangement of the type described as a rule meet the consumer demands raised in respect of openability and good pouring properties but, as far as is known, none of these opening arrangements up to now has provided a satisfactory solution to the further consumer requirement, that the package should also be functionally reclosable so as to give, after only a partial emptying of the contents, at least physical protection to the remaining contents until the next occasion for emptying.

Among a number of earlier, one was based on providing at least one, preferably the bottom one, of two strip portions with a thin layer of pressure-sensitive adhesive, with the help of which the two strip portions could be recombined with good adhesion after each opening. Another suggestion was to provide the opening arrangement with a mechanical reclosing arrangement of the type, for example, which is described in Swedish patent no. 451 012, and according to which the upper strip portion possesses a gripping strip applied separately to its underside which, on reclosure of the container, is adapted to hook mechanically onto the free end of the bottom strip portion serving as a pouring edge.

The problem with an opening arrangement in accordance with the first-mentioned suggestion is that the adhesive layer, which is freely exposed after the opening of the container, is sensitive to dust and similar dirt occurring in the surroundings of the container which easily fastens onto, and "neutralizes" the adhesiveness of this layer necessary for the reclosing. The contents of the package too, which during the pouring come into contact with the underlying, preferably adhesive-coated, strip portion tend to adhere to, and wet, the sticky surface of the adhesive layer, which contributes further to the impairing of the reclosing capacity of the opening arrangement. The problem with the mechanical arrangement described above is that it has been found to be much too difficult in practice, on reclosing of the container, to apply the upper strip portion provided with the gripping strip in the required correct position in relation to the pouring edge of the bottom strip portion in order to retain effectively the upper strip portion by an engagement between the gripping strip and the pouring edge.

OBJECTS AND SUMMARY OF THE INVENTION

It is an object of the present invention, therefore, to provide a packing container with an opening arrangement which functions well during opening and pouring as well as during reclosing without the attendant inconveniences of the type described above.

This object, among others, is achieved by a packing container provided with an opening arrangement, which includes a double strip applied to the outside of the container having two overlapping strip portions which are adapted to close, in an openable manner, an opening in the container. The strip portions are joined to one another by means of one or more protruding parts of the bottom strip portion which are adapted to engage positively in corresponding seats formed in the upper strip portion to allow reclosing of the container.

BRIEF DESCRIPTION OF THE DRAWINGS

In the following the invention will be described in greater detail with special reference to the attached drawings, wherein:

In FIG. 1 is shown thus the upper part of a conventional, so-called non-returnable, package 2 provided with an opening arrangement 1 in accordance with the invention which has an opening 4 incorporated in the substantially planar, rectangular top side 3 of the package. The design and the placing of the opening 4, through which the contents of the package are to be emptied, may vary and is of no real significance for the invention itself, although for practical reasons it has been found to be most appropriate to give the opening the placing as shown in FIG. 1 close to one of the corner areas of the upper side 3.

Figure 2:
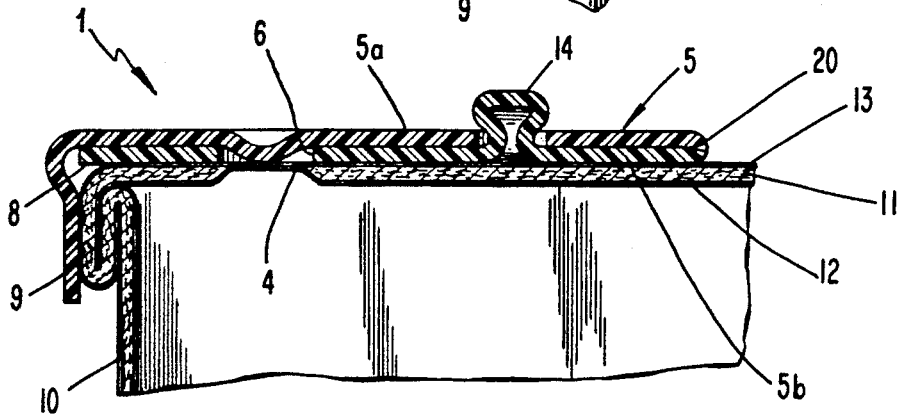
FIG. 2 is a cross-sectional view of the container and the opening arrangement along the line II—II in FIG. 1.

As is evident from FIG. 2, the opening arrangement 1 comprises a doubled strip 5 applied to the outside of the container which is so dimensioned and placed that the two overlapping portions 5*a* and 5*b* of the strip wholly cover the opening 4 incorporated in the container side 3. The bottom strip portion 5*b* is attached firmly to the outside of the package and has a hole 6 of an appropriate shape incorporated in the region of the package opening 4. The bottom strip portion 5*b*, moreover, is placed so that its front or free end reaches up to, or slightly projects over, an adjacent boundary line 7 on the package side 3 in order to form a pouring edge 8. The upper, forwards folded strip portion 5*a* covers the package opening 4 as well as the hole 6 in the bottom strip portion 5*b* and is slightly longer than the underlying strip portion in order to form a pull-tab 9. The pull-tab 9 is folded down around the pouring edge 8 and is joined detachably to the outside of the adjacent vertical side wall 10 of the package. The package 2, as mentioned earlier, can be manufactured from a web of a laminated material comprising, for example, a carrier layer of paper 11 and outer coatings 12 and 13 of thermoplastics, preferably of polyethylene, which on the one hand give the package the necessary tightness qualities against liquid and on the other hand make it possible for the package to be made permanent in its desired final shape by means of heat-sealing. In such a packing material the opening 4 preferably is constituted by a hole punched out solely in the paper layer 11 of the material, which from the inside is covered by the unbroken inner thermoplastic coating 12 for protection of the absorbent cut edge of the punched-out hole. The doubled strip 5 preferably consists of a heat-sealable material, e.g. polyethylene which makes it possible to seal the bottom strip portion 5*b* firmly to the outer thermoplastic coating 13 of the package by heat-sealing and which makes it possible, moreover, to join, likewise by heat-sealing, the upper strip portion 5*a* to the inner thermoplastic coating 12 within the region of the opening 4, as shown in FIG. 2. In order to retain the upper strip portion 5*a* securely in the forwards folded position on the liquid-tight sealed package shown in FIG. 2, the two overlapping strip portions preferably are attached to one another by a sealing joint which ought to be sufficiently strong to resist external stresses to which the package is exposed in normal transport and handling, but which, at the same time, should be sufficiently weak so as not to make difficult the opening of the package. Such an optimum sealing joint between the strip portions 5*a* and 5*b* is achieved by coating, for example, one of the strip portions with a so-called protective varnish or other suitable seal-weakening material prior to the doubling and heat-sealing of the strip.

Figure 4:
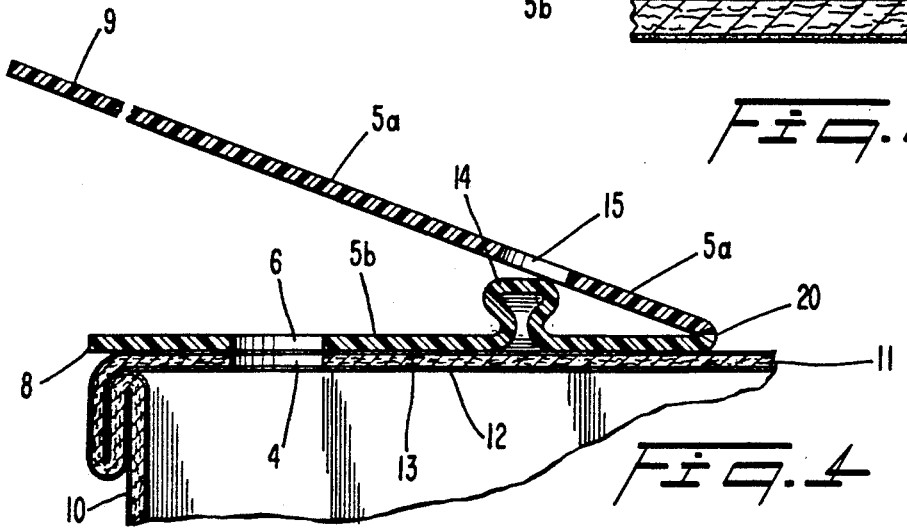
FIG. 4 is a cross-sectional view of the packing container in accordance with FIG. 1 with the opening arrangement in an open position.

When the package 2 is to be opened, the pull-tab 9 is grasped and the upper strip portion 5*a* is pulled upwards and backwards towards the open position shown in FIG. 4. The weakened seal joint between the strip portions successively then lets go along the sealing region at the same time as the inner thermoplastic coating 12 covering the opening 4 from underneath, which is sealed with strong adhesion to the upper strip portion 5*a*, is stretched and torn off towards the lower cut edge of the hole around the whole opening contour to expose a corresponding pouring opening through the overlapping or coinciding holes 4 and 6 in the paper layer 11 and the bottom strip portion 5*b* respectively. The contents of the package thereafter are poured through the pouring opening and along the bottom strip portion 5*b*, and the contents leave pouring edge 8 of the package in a coherent and easily directed jet.

Figure 3:
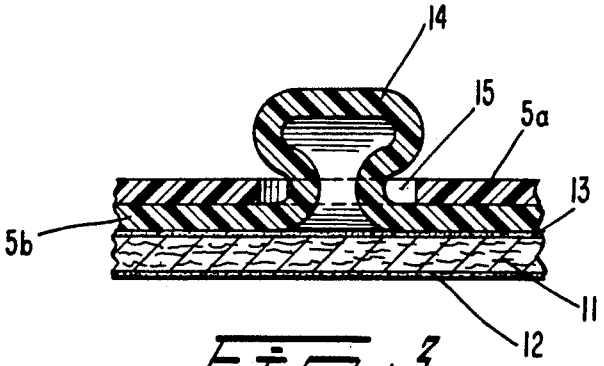
FIG. 3 is an enlarged cross-sectional view of the ringed area in FIG. 2.

After the desired amount of the contents of the package has been emptied, the package 2 is reclosed. The backwards folded, upper strip portion 5*a* is folded forward again until it lies flat against the bottom strip portion 5*b* so as to cover the existing emptying opening, in order to protect the remaining contents of the package until the next emptying process. To make possible such a reclosing of the package the strip 5 is provided with a protruding part or projection 14 which is adapted to engage positively in a corresponding seat or hole 15 formed in the upper strip portion, as is evident from FIGS. 3 and 4. The projection 14 is dimensioned so that it can be taken up with a sufficiently good positive fit in the hole 15 in the upper strip portion so as to retain detachably the upper strip portion 5*a* in its flat reclosure position. The projection 14 constitutes an integral part of the strip 5 and can be produced advantageously by swaging, preferably through the hole 15 produced previously in the upper strip portion. As is shown in FIGS. 2 and 4, the upper and lower strip portions 5*a*, 5*b* are hinged to each other at a location (20) spaced from the hole 15 and the projection 14.

Figure 1:
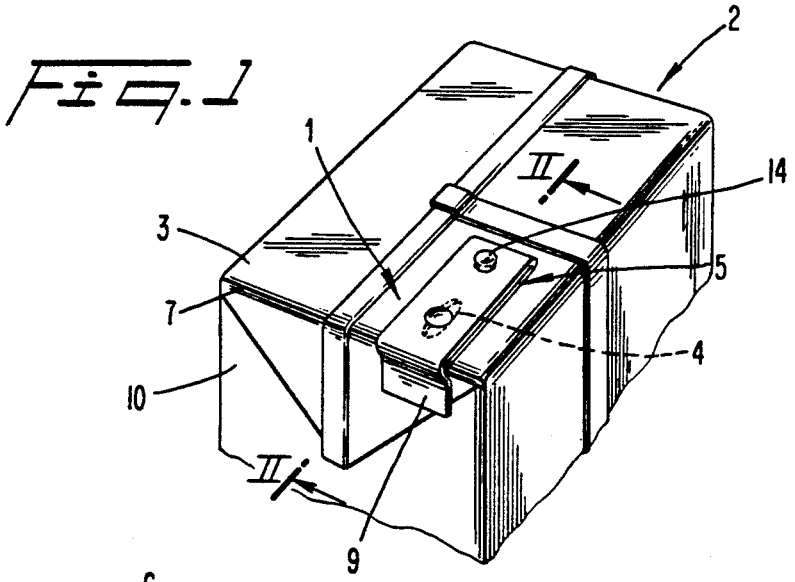
FIG. 1 is a top perspective view of a conventional packing container provided with an opening arrangement in accordance with the invention.
Figure 5:
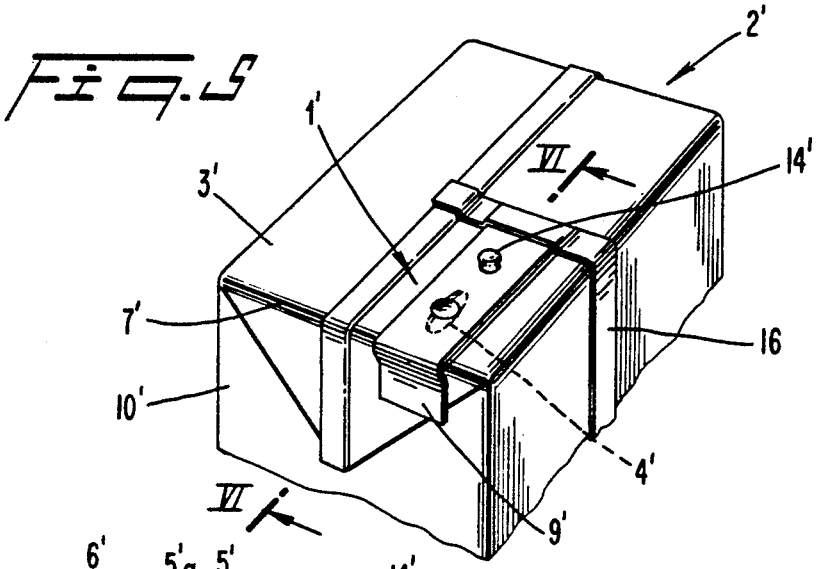
FIG. 5 is a top perspective view of a conventional packing container provided with an opening arrangement in accordance with a second embodiment of the invention.
Figure 6:
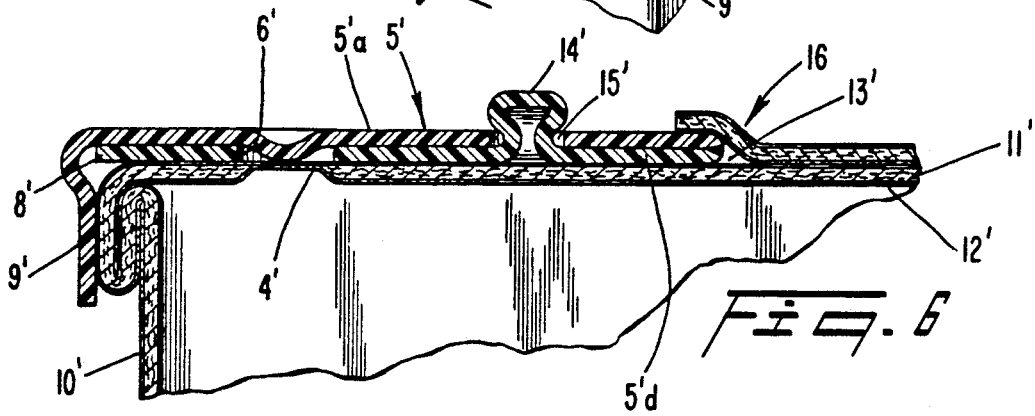
FIG. 6 is a cross-sectional view along line VI—VI in FIG. 5 of the container and the opening arrangement according to the third embodiment.

FIG. 5 illustrates the upper part of a conventional, non-returnable, package which has been provided with an opening arrangement in accordance with another embodiment of the invention. In order to facilitate a comparison between this opening arrangement and the one described earlier the same references have been used in FIGS. 5 and 6 as in FIGS. 1–3 for identical or similar parts, but with the addition of a prime sign. The opening arrangement 1' differs from the earlier one in that, as is evident from FIG. 6, it has a double strip 5' in the form of two separate strip portions 5'*a* and 5'*b* joined detachably to one another, whose rear overlapping ends are inserted and sealed firmly in an overlap joint 16 formed during the manufacture of the package, the inner thermoplastic coating 12' of the package being joined directly to the top side of the upper strip portion 5'*a*, whereas the outer thermoplastic coating 13' of the package is joined directly to the underside of the bottom strip portion 5'*b* within the region of the overlap joint 16. The package 2' is opened when the front end 9' of the upper strip portion 5'*a*, serving as a pull-tab, is grasped and is drawn and, upwards to an opening position corresponding to that shown in FIG. 4. During opening, the seal between the two strip portions 5'*a* and 5'*b* is broken, and the inner thermoplastic coating 12' attached firmly to the upper strip portion 5'*a* within the region of the package opening 4' is torn off to expose an emptying opening formed by the opening 4' in the upper side of the package and a corresponding hole 6' formed appropriately in the bottom strip portion 5'*b*. On reclosing, the upper strip portion 5'*a* is refolded until it rests flat against the bottom strip portion 5'*b*, and in order to retain the upper strip portion 5'*a* securely in this folded down reclosure position the bottom strip portion has a preferably swaged, protruding part or projection 14', which is adapted so that it can engage detachably with a good fit in a corresponding seat or hole 15' incorporated in the upper strip portion 5'*a*.

Figure 8:
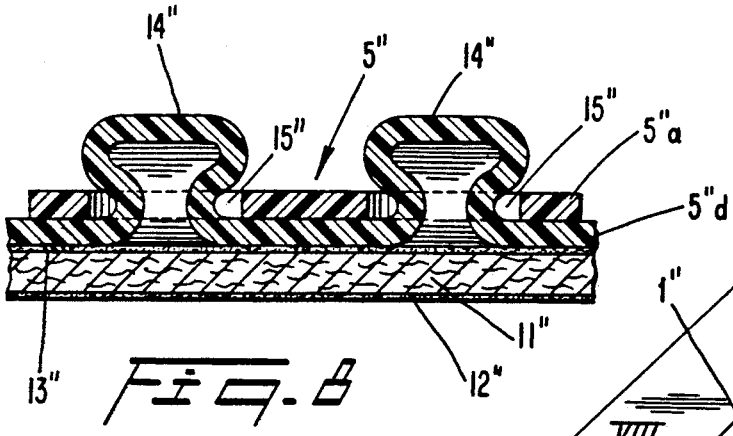
FIG. 8 is a cross-sectional view along line VIII—VIII in FIG. 7 of the container and the opening arrangement according to the third embodiment.
Figure 7:
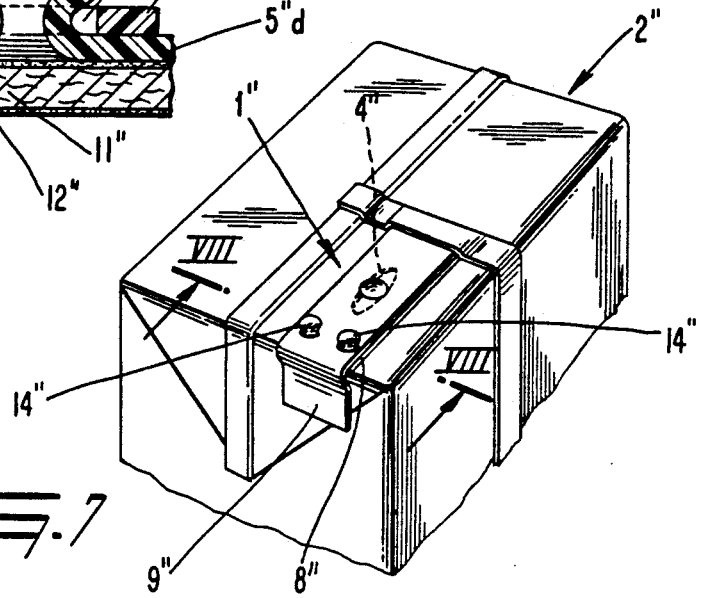
FIG. 7 is a top perspective view of a conventional packing container provided with an opening arrangement in accordance with a third embodiment of the invention.

FIGS. 7 and 8 show an opening arrangement in accordance with a further embodiment which can be formed on a package 2'' of the same type as used in the other embodiments. For the sake of clarity the same reference designations are used here as were used previously for identical or corresponding parts, but with the addition of a double prime sign.

The opening arrangement 1'' differs from the opening arrangement 1' essentially only in that the double strip 5'', which comprises two separate strip portions 5''*a* and 5''*b* joined detachably to one another, has two, preferably swaged, protruding parts or projections 14'' formed in the bottom strip portion 5''*b* and, correspondingly, two seats or punched holes 15'' formed in the upper strip portion 5'', and that the projections 14'' and holes 15'' are located in a strip region in front of the opening 4'' in the intended direction of pouring. So as not to be an obstacle to the emptying of the package, the projections 14'' ought to be located as near as possible to the respective strip edges so as to give the maximum possible troublefree passage for the contents.

It ought to be pointed out especially that the expression "seats" does not, of course, refer exclusively to through-holes, as shown in the drawings, but may also refer to cavities formed by means of corresponding swaging such as that used in connection with the bottom strip portion for the formation of the protruding parts. The protruding part in the bottom strip portion then is intended to engage positively in the protruding part formed by swaging in the upper strip portion. Preferably the cavity and the protruding part are formed by simultaneous swaging of the two strip portions.

Thus, in accordance with the present invention a packing container is provided with an opening arrangement which meets well the consumer demand concerning openability and pouring properties and which, moreover, makes the container functionally reclosable.

While this invention has been illustrated and described in accordance with a preferred embodiment, it is recognized that variations and changes may be made therein without departing from the invention as set forth in the claims.

What is claimed is:

1. A packing container formed at least partly by a wall having an outside surface and an opening arrangement for removing the contents of the container through an opening in the wall, said opening arrangement comprising: upper and lower strips, said lower strip being secured to said outside surface adjacent said opening, said upper strip being arranged in overlapping relation with said lower strip and having a hole formed therein, and said lower strip having a protruding part arranged to protrude through said hole, said upper strip overlapping said lower strip and covering said opening when said protruding part protrudes through said hole whereby said opening arrangement allows reclosing of the container, said lower strip being hinged to said upper strip at a location spaced from said protruding part.

2. A packing container provided with an opening arrangement as claimed in claim 1, wherein said protruding part is an integral part of said lower strip.

3. A packing container provided with an opening arrangement as claimed in claim 2, wherein said protruding part is swaged through said hole in said upper strip.

4. A packing container provided with an opening arrangement as claimed in claim 1, wherein said container has a side wall spaced from said opening, and said protruding part is located in a region spaced from said side wall a distance greater than said opening in said container, so as not to form an obstacle to emptying of the contents of said container through said opening.

5. A packing container provided with an opening arrangement as claimed in claim 1, wherein said upper strip and said lower strip are detachably sealed to one another.

6. A packing container provided with an opening arrangement as claimed in claim 1, wherein said upper and lower strips are formed by an integral, double strip.

7. A packing container provided with an opening arrangement as claimed in claim 1, wherein said upper and lower strips are made of polyethylene.

8. A packing container provided with an opening arrangement as claimed in claim 7, wherein said lower strip is firmly attached to the outside of said container by heat-sealing.

9. A packing container provided with an opening arrangement as claimed in claim 8, wherein said lower strip includes a pouring edge projecting slightly beyond a boundary line of the container side and said upper strip includes a pull-tab folded around said pouring edge and joined detachably to an outside surface of the container.

10. A packing container provided with an opening arrangement as claimed in claim 1, wherein said container has a side wall spaced from said opening, and said protruding part is located in a region between said side wall and said opening and laterally offset relative to said opening in said container, so as not to form an obstacle to emptying of the contents of said container through said opening.

* * * * *